US006956725B2

(12) United States Patent
Boughton, Jr. et al.

(10) Patent No.: US 6,956,725 B2
(45) Date of Patent: Oct. 18, 2005

(54) CURRENT CONTROLLED CONTACT ARC SUPPRESSOR

(75) Inventors: Donald H. Boughton, Jr., Pullman, WA (US); Tony J. Lee, Pullman, WA (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 84 days.

(21) Appl. No.: 10/246,970

(22) Filed: Sep. 18, 2002

(65) Prior Publication Data

US 2004/0052012 A1 Mar. 18, 2004

(51) Int. Cl.[7] ..... H02H 3/00
(52) U.S. Cl. ..... 361/7
(58) Field of Search ..... 361/7, 2, 3, 5, 361/6, 8, 10, 13, 35

(56) References Cited

U.S. PATENT DOCUMENTS 4,420,784 A * 12/1983 Chen et al. ..... 361/7
4,618,906 A * 10/1986 Paice et al. ..... 361/5
4,652,962 A * 3/1987 Howell ..... 361/3
4,704,652 A * 11/1987 Billings ..... 361/5
5,652,688 A * 7/1997 Lee ..... 361/13

* cited by examiner

*Primary Examiner*—Brian Sircus
*Assistant Examiner*—James A. Demakis
(74) *Attorney, Agent, or Firm*—Cook, Alex, McFarron, Manzo, Cummings & Mehler, Ltd.

(57) ABSTRACT

The arc suppression system for electrical contacts includes a transistor, such as an IGBT, which is connected across the contacts. A control circuit controls the operation of the transistor such that the turning on of the transistor results in a current path around the contacts, thereby tending to prevent arcing across the contacts. A current sensor, such as a flyback transformer, is positioned in series with the contacts, wherein when the contacts open, current is interrupted through the contacts and the transformer, a secondary voltage results which is applied to the transistor, which tends to maintain the transistor on for a time which is sufficient to allow the contacts to either open or close without an arc.

9 Claims, 1 Drawing Sheet

CURRENT CONTROLLED CONTACT ARC SUPPRESSOR

TECHNICAL FIELD

This invention relates generally to a circuit for suppression of arcing between two electrical contacts, and more particularly concerns such a protection circuit which makes use of the current through the contacts to control the arc suppression circuit, following either the opening or closing of the electrical contacts.

BACKGROUND OF THE INVENTION

It is a well-known problem that when the flow of current to an inductive load through a switch or relay contacts is either interrupted or initiated (such as by opening or closing and subsequent bouncing of the switch), the energy in the inductive load is transferred to a voltage spike, which causes an electrical arc to form between the contacts. This arcing damages the contact terminals.

There are numerous patents which attempt to remedy or lessen the effect of the above-described condition. U.S. Pat. No. 5,703,743 to Lee, which is owned by the assignee of the present invention; U.S. Pat. No. 4,658,320 to Hongel and U.S. Pat. No. 4,438,472 to Woodworth all use an external "Miller capacitance" to cause a shunt-connected transistor to turn on during a high dv/dt event, such as the switch or relay contact terminals opening. However, these patents all typically operate during any high dv/dt event, including application of power to the DC circuit. Usually, this is undesirable.

Other patents include U.S. Pat. No. 4,959,746 to Hongel; U.S. Pat. No. 745,511 to Kugelman et al; U.S. Pat. No. 5,548,461 to James and U.S. Pat. No. 5,081,558 to Mahler. All of these patents use an inductive winding which is coupled to the primary side of the circuit to turn the shunt transistor on and off. Kugelman uses an optical coupler which senses the current to the relay in order to turn the shunt transistor for the contacts on and off. James uses an optical sensing device which turns on when the light from the arc across the contacts appears. The Mahler patent appears to combine the teaching of the above patents and the '746 Hongel patent. It uses the external Miller capacitance to protect the contacts during turn off (contacts open) and an inductor winding magnetically coupled to the relay coil to turn the transistor on to protect the contacts during closing of the contacts. These patents also will turn on the shunt protection transistor positioned across the contact terminals during any high dv/dt event.

Accordingly, a circuit which provides protection against arcing when the contacts open and close, but does not operate in response to a circuit DC voltage application or other high dv/dt event when the contacts are open, is desirable.

SUMMARY OF THE INVENTION

Accordingly, the present invention is a circuit for suppression of arcing between electrical contacts, comprising: a transistor connected across the contacts; a control circuit for controlling the operation of the transistor, wherein turning on the transistor results in a current path around the contacts, which tends to prevent arcing between the contacts; and a current sensor in series with the contacts, wherein when current is interrupted through the contacts by opening the contacts or when current occurs through the contacts when the contacts are just closed, a voltage is produced which is applied to the transistor, which maintains the transistor on for a sufficient time to prevent arcing.

BEST MODE FOR CARRYING OUT THE INVENTION

In general, the present invention uses an inductance, in particular, a saturable flyback transformer in the embodiment shown, and the current therethrough, which is positioned in series with the contact terminals which are connected to the load to control an arc suppression circuit for the contacts.

The flyback transformer stores energy when the contact terminals are closed. When the terminals open, the energy in the flyback transformer is transferred to a capacitor connected to the secondary of the transformer very quickly in a flyback action. The voltage on the capacitor is used to power a switch control circuit, which assists in turning the protection transistor connected across the contacts on and maintaining it on. A small amount of additional "Miller capacitance" is used to help turn on the protection transistor faster than otherwise. Generally, this invention may be used with all kinds of shunt (by-pass) transistors. The basic electrical circuit which controls the protection transistor is also well known. The energy from the secondary circuit, stored in the flyback transformer when it is in a saturated condition, provides the energy to drive the protection (by-pass) transistor or other high-speed switching device when the contacts open or close.

As indicated above, the present invention includes a transistor which forms a by-pass (shunt) around the switch or relay contacts, preventing damage due to arcing, which is particularly useful when the load is inductive. The present invention protects against arcing, both in the opening and closing of the protected contacts, as well as preventing the protection transistor from turning on when the contacts are open and the DC circuit feeding the protected contacts is energized, or other high dv/dt events. It is undesirable to have the protective transistor turn on in response to such high dv/dt events when the contacts are open.

Figure 1:
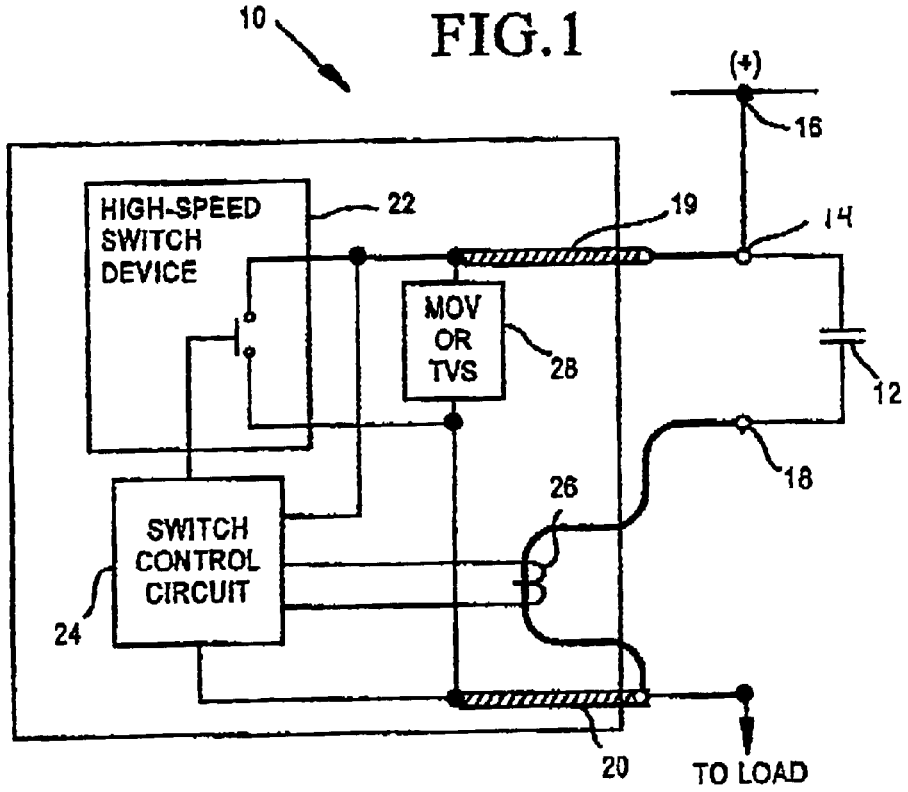
FIG. 1 is a block diagram of the system of the present invention.

FIG. 1 shows a block diagram of the protection circuit of the present invention, shown generally at 10. The circuit protects contact terminals 12, which are connected at one side 14 to the positive side 16 of a DC supply, with the other side 18 connected to the load. The two sides 14, 18 of the contacts 12 are connected to terminal posts or blocks 19 and 20, respectively, which are the physical connections to the protection circuit 10. The protection circuit 10 operates by briefly by-passing or shunting current produced by the inductive load around the contact terminals 12 through a high-speed switching device 22, which is typically a transistor or similar device, during opening or closing of contacts 12. Switching device 22 is controlled by a control circuit 24, which operates in response to voltage developed across the protected contacts 12 and current through an inductor 26, typically a flyback transformer, during opening and closing of the contacts. The energy stored in flyback transformer 26 provides the energy to operate control circuit 24.

Briefly, when contacts 12 close, high-speed switch device 22 is turned on for a very short time to protect contact terminals 12 from arcing when the terminals bounce following initial contact. Further, when contacts 12 open, high-speed switch 22 is turned on to prevent an arc from forming during the separation of the contacts, remaining on long enough for the contact terminals to separate sufficiently to withstand substantial voltage (several hundred volts) without arcing. The high-speed switch then turns off and a transient voltage suppressor, in particular metal oxide varistor (MOV) 28 or other similar equivalent device, will clamp the flyback voltage to several hundred volts and dissipate the energy stored in the inductive load in the form of heat.

When contacts 12 are open, and there is no current flowing through the contacts, the switch control circuit 24 will not operate to protect the contacts, i.e. will not turn on the high-speed switch device for longer than a negligible period of time. The high-speed switch thus is prevented from turning on in response to the DC circuit for the protected contacts being energized, avoiding temporary load energization for such high dv/dt events.

One important aspect of the present invention is the use of the inductor (flyback transformer) 26 and the current therethrough to turn on the high-speed switch following both the opening and the closing of contacts 12.

In the circuit of FIG. 1, the high-speed switch 22 can be any one of various transistors, and the contacts, again, can be any one of various switch and/or relay contact arrangements, including magnetic, manual, optical or other types of contacts.

Figure 2:
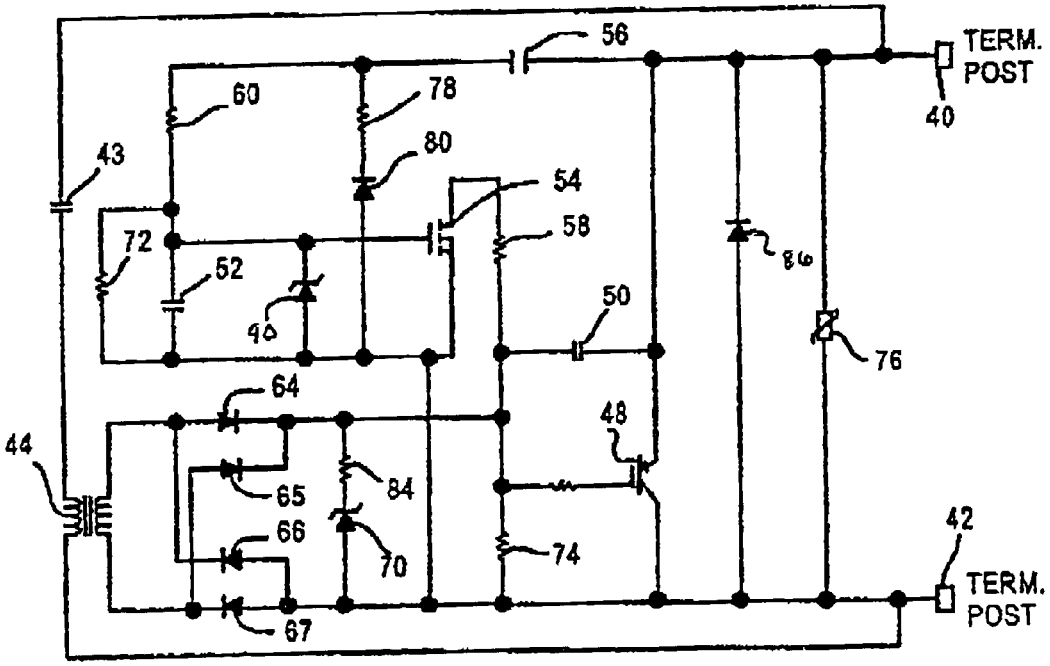
FIG. 2 is a more detailed schematic drawing of the system of the present invention.

Referring now to FIG. 2, which shows one specific implementation of the circuit of the present invention. Terminal posts 40 and 42 correspond to terminal blocks 19 and 20 in FIG. 1. The protected contacts 43 correspond to protected contacts 12 in FIG. 1.

When the protected contacts 43 are closed (and are now to be opened), and a load current is flowing through them, such as approximately 800 mA or greater, the current through the protected contacts 43 is also applied through the primary or center winding of a toroidal inductor (flyback transformer) 44. The transformer will be saturated under normal conditions with the above current when contacts 43 are closed. When the contacts are opened, presenting the possibility of an arc, the voltage across the contacts will begin to rise due to the LRC circuit formed by the inductance, series resistance and parasitic winding capacitance associated with the load.

When this voltage reaches the threshold rating of high-speed switching transistor 48, which in the embodiment shown is an IGBT transistor, a current will begin to flow from the collector (positive terminal) of transistor 48 into its gate, through capacitor 50. This results in transistor 48 quickly turning on, which will prevent the voltage across contacts 43 from further increasing. Transistor 48 will remain in a linear operating mode for a brief time, with a contact voltage of about 8–12 volts and an dv/dt of about 20 volts per millisecond. Capacitor 52 prevents the collector voltage from transistor 48 turning transistor 54 on through capacitor 56 and resistances 72 and 60. Transistor 54 in the embodiment shown is a MOSFET transistor and is part of the control circuit for transistor 48.

In addition, when the contacts 43 open, the current through inductor 44 (the primary of the flyback transformer) is interrupted, which results in a collapse of the magnetic field sustained by that current. This causes the voltage in the secondary of the transformer to increase rapidly. That secondary voltage is applied to a full wave rectifier comprising diodes 64–67, which is used to heavily charge the gate of transistor 48 and capacitor 50. In a relatively short time (1–12 microseconds), transistor 48 is driven into saturation and capacitor 50 is charged to 15 volts, the value of which is limited by zener diode 70, because of its breakdown voltage of 15 volts. Resistors 60 and 72 keep the gate voltage of transistor 54 below its minimum rated threshold voltage, as long as the collector of transistor 48 is below its maximum saturation voltage.

After all of the energy stored in transformer 44 has been dissipated to capacitor 50, transistor 48 and zener diode 70, capacitor 50 will begin to discharge through resistor 74. Transistor 48 will remain in saturation until its gate voltage decays to its threshold value, which takes about 1.2 milliseconds. When the gate voltage reaches that threshold, transistor 48 begins to turn off and capacitor 50 will conduct, keeping transistor 48 turned on in a linear mode, with an increasing dv/dt of approximately 16 volts/ms. As the voltage across transistor 48 increases, the gate voltage of the transistor 54 will begin to increase as well. In about 300–500 microseconds, the gate voltage of transistor 54 will reach its threshold voltage and will begin to conduct, charging capacitor 56 and turning transistor 48 off very quickly. As transistor 48 turns off, its collector voltage, which is increasing, turns transistor 54 on harder, which in turn turns transistor 48 off harder, in a cyclical manner.

Accordingly, transistor 48 will protect the contact terminals 43 by shunting the load current around the contact terminals for a period of 3–4 milliseconds, which allows the contact terminals 43 to separate sufficiently that they can withstand several hundred volts without arcing. The collector voltage of transistor 48 will continue to rise at a rate of about 60–85 volts per microsecond, until it reaches the clamping voltage of the metal oxide varistor (MOV) 76, which is typically several hundred volts. At this point, the current through transistor 48 is transferred to MOV 76. MOV 76 dissipates the energy from the external inductance as heat, and the load current goes down to zero. When the current through the load reaches zero, the voltage across MOV 76, protecting transistor 44 and contacts 43, will return to the open circuit voltage of the protected contacts 43.

When the contacts are closed, after being open, there is a risk of arcing as the contacts again open slightly for a very short period of time, which is referred to as contact "bounce". In this mode, capacitor 56 will discharge through contacts 43, resistance 78 and diode 80. The peak discharge current is limited by resistor 78, which reduces the effect of the current on diode 80.

Likewise, capacitor 50 discharges through parallel discharge paths of zener diode 70, which is current-limited by resistor 84 and the internal diode of transistor 54, which is current-limited by resistor 58. This current limitation by the resistors improves the life of the circuit as a whole.

Current increases through the primary of flyback transformer 44 following closing of the contacts 43, because current is now flowing through the protective contacts, resulting in a voltage in the secondary winding of the flyback transformer, which in turn charges the gate of transistor 48 and also begins to charge capacitor 50. This voltage is limited to 15 volts by the zener diode 70. Transistor 48 is driven into saturation, providing a current by-pass (shunt) path and protecting the contact terminals from arcing during bouncing at closing of the contacts.

Capacitor 50 will be discharged by resistor 74 in approximately 3–4 milliseconds after the contacts close, causing transistor 48 to turn off. The current through the primary of flyback transformer 44 will eventually cause the transformer to saturate; the circuit is then in a state to protect the contact terminals when they open, as explained above.

When the contacts 43 are fully open, but the voltage across the contacts is zero, the current through the flyback transformer 44 will be zero and no energy will be stored in the transformer. When the contact terminals are connected across a DC voltage, the contact voltage, as indicated above, will increase rapidly; when it reaches the threshold voltage rating of the IGBT transistor 48, a current will begin to flow from the positive contact terminal (or the collector) of transistor 48 through capacitor 50 and into the gate of transistor 48, as explained above. In a short time, transistor 48 will turn on and prevent the contact voltage from increasing any further.

Transistor 48 will remain in linear mode with a contact voltage of about 8–12 volts and a dv/dt rate of about 20 volts/ms, which results in a "let-through" current to the load. Since there is no stored energy in the flyback transformer, however, to further turn on the transistor 48, the transistor 48 will remain at 8–12 volts and capacitor 52 will continue to charge through capacitor 56 and resistors 60 and 72. When capacitor 52 charges to the threshold voltage of transistor 54, it will begin to conduct, charging capacitor 50 and turning transistor 48 off very quickly. As transistor 48 turns off, its increasing collector voltage turns on transistor 54, which in turn turns transistor 48 off harder. Capacitor 52 and resistors 60 and 72 are designed to charge to the threshold voltage in about 30–95 microseconds. The duration of the let-through current is thereby limited to less than 95 microseconds, virtually eliminating the problem of previous circuits where the high-speed switch would operate in response to the DC circuit being energized.

Capacitor 56, in addition to the above function, is designed to AC couple the turn-on circuit for transistor 54, which comprises resistors 60, 72 and capacitor 52. By AC coupling the turn-on circuit for transistor 54, the DC leakage current from the positive terminal to the negative terminal is significantly reduced. During transient operations, capacitor 56 appears as a short circuit. Diode 86 is provided to protect the device from polarity reversals such as occurs when the terminals are connected backwards. A zener diode 90 is provided to protect the transient voltages from damaging transistor 54.

Accordingly, a circuit has been disclosed which protects electrical contacts from arcing, both during opening and closing of terminals. It makes use of an inductive element operating off the secondary (load) side current of the contacts to control the operation of a high-speed transistor, such as an IGBT, which by-passes (shunts) current around the contacts for specific times to prevent arcing. In addition, the invention limits the time the resulting current due to circuit energization and other high dv/dt events is allowed to flow through the load to less than about 95 microseconds.

Although a preferred embodiment of the invention has been described for purposes of illustration, it should be understood that various changes, modification and substitutions may be incorporated in the embodiment without departing from the spirit of the invention which is defined in the claims which follow.

What is claimed is:

1. A circuit for suppression of arcing between electrical contacts, comprising:

a transistor connected across the contacts;

a control circuit for controlling the operation of the transistor; and a current sensor in series with the contacts, wherein when current chances as a consequence of the contacts opening or closing, said current sensor produces in response to said current change a voltage which is applied by said control circuit to the transistor to maintain the transistor conductive for a sufficient time to suppress arcing between the contacts.

2. The circuit of claim 1, wherein the current sensor is a transformer having a primary winding connected in series with the contacts and a secondary winding connected to said control circuit.

3. The circuit of claim 1, wherein as the contacts open and current is interrupted, an LRC voltage is produced by an LRC circuit associated with the load which is applied to the transistor, which initiates a fast transition to a conductive state of the transistor.

4. The circuit of claim 2, wherein as the contacts open and current is interrupted, a collapsing magnetic field in the primary winding produces a voltage in the secondary winding which is applied to the transistor, maintaining the transistor in a conductive state for a sufficient period of time to suppress arcing between the contacts.

5. The circuit of claim 1, wherein the transistor is an IGBT transistor.

6. The circuit of claim 1, wherein the control circuit includes a MOSFET transistor having a gate, and wherein in response to opening of the contacts, voltage at the gate increases as voltage across the contacts increases until a selected MOSFET threshold voltage is reached, which causes the MOSFET to conduct, resulting in the transistor quickly transitioning to a nonconductive state.

7. The circuit of claim 1, including a metal oxide varistor (MOV) having a clamping voltage, which is connected across the transistor to bypass current flow through the transistor when the collector voltage of the transistor reaches the clamping voltage of the MOV.

8. The circuit of claim 2, wherein when the contacts close and current begins to flow through the contacts and the primary winding of the transformer, a voltage is developed in the secondary winding of the transformer, which is applied to the transistor, maintaining the transistor in a conductive state, such that the transistor bypasses current through the contacts for a short period of time sufficient to suppress arcing between the contacts.

9. The circuit of claim 1, wherein the current sensor is a flyback transformer.

* * * * *